United States Patent [19]

Kawai

[11] Patent Number: 5,004,173

[45] Date of Patent: Apr. 2, 1991

[54] METHOD OF CONTROLLING WEB FEEDING DEVICE

[75] Inventor: Hideshi Kawai, Kasugai, Japan

[73] Assignee: Isowa Industry Company Ltd., Nagoya, Japan

[21] Appl. No.: 335,347

[22] Filed: Apr. 10, 1989

[30] Foreign Application Priority Data

Apr. 16, 1988 [JP] Japan ..... 63-94331

[51] Int. Cl.[5] ..... B65H 19/02

[52] U.S. Cl. ..... 242/57; 242/58.6; 242/68.4

[58] Field of Search ..... 242/57, 68.4, 68.7, 242/58.6, 79

[56] References Cited

U.S. PATENT DOCUMENTS 3,806,058 4/1974 Münchbach ..... 242/58.6 X
4,706,905 11/1987 Torres ..... 242/68.4
4,773,609 9/1988 Steffen et al. ..... 242/57 X

*Primary Examiner*—Stuart S. Levy

*Assistant Examiner*—Steven M. duBois

*Attorney, Agent, or Firm*—Schwartz & Weinrieb

[57] ABSTRACT

There is disclosed a method of controlling a web feeding device comprising a pair of center blocks disposed upon predetermined movable members so as to oppose each other with their axes being aligned so as to perform loading and unloading of a web roll by moving closer to or farther away from each other, a lifter disposed adjacent to the movable members and vertically driven so as to elevate the web roll loaded thereon, and a sensor which detects alignment of the pair of center blocks with the core tube of the web roll; wherein:

the pair of center blocks are stopped at a predetermined position, prior to the ascending stroke of the lifter, by moving said movable members;

the lifter having the web roll loaded thereon is ascended; and the alignment of the core tube of the web roll with the pair of center blocks is detected by the sensor so as to instantaneously stop the ascending motion of the lifter.

21 Claims, 7 Drawing Sheets

METHOD OF CONTROLLING WEB FEEDING DEVICE

FIELD OF THE INVENTION

This invention relates to a method of controlling a web feeding device which can efficiently achieve loading and unloading of web rolls.

BACKGROUND OF THE INVENTION

There have been widely used, for example, corrugators or corrugating equipment in which a corrugating medium is manufactured so a to have corrugations with a desired pitch size. The medium is then glued together with a liner across the crests of the corrugations using an adhesive so as to form a single-faced corrugated board sheet. The resulting single-faced corrugated board sheet is then adhesively bonded with a back liner so as to form a double-faced corrugated board sheet. In such type of corrugators, cardboard web feeding devices, for rotatably supporting rolls each of which comprises a core tube having wounded thereon a cardboard web such as, for example, a corrugating medium, liner and back liner (these cardboard webs are hereinafter referred to as a "web"; and a roll having such a web wound thereon is hereinafter referred to as a "web roll") so as to feed webs therefrom, are indispensable.

As a prior art web feeding device to be employed within a corrugator, a mill roll stand having a so-called swing arm system as shown in FIG. 6 is widely known. The mill roll stand shown with the numeral 10 comprises two pairs of swing arms 13, each pair comprising a right arm and a left arm which are connected to horizontal pivotal shafts 11 and 12, respectively, by means of splines. The respective arms 13 have a center block 16 at the inner end thereof such that it may oppose its counterpart provided upon the other arm 13, and can be fitted into the end portions of a core tube 15 of a web roll 14. A transportation means 17 comprising a flat car or the like for transporting the web rolls 14 into and out of the corrugator equipment is provided at a position below the swing loci of the respective pairs of swing arms 13.

In order to achieve the loading of a web roll 14 onto one pair of swing arms 13 supported, for example, upon the right side pivotal shaft 12 within the mill roll stand 10, the transportation means 17, having had a web roll 14 loaded thereon at a specified stockyard is allowed to travel until it reaches below the swing loci of the swing arms 13, at which time the swing arms 13 are laterally spaced from each other, and in this state the right side pivotal shaft 12 is pivoted or rotated in the clockwise direction until the center blocks 16 are coaxially aligned with the axis of the core tube 15 of the web roll 14.

Subsequently, the swing arms 13 are moved closer to each other along the common axis thereof so as to effect chucking of the core tube 15 of the web roll 14 by means of the center blocks 16, and then the arms 13 are swung in the counterclockwise direction whereby loading of the web roll 14 (also referred to as the "web setting" operation) is achieved.

There is occasionally employed a mill roll stand which includes a turn-over system in which arms extending from the pivotal shaft in the opposite directions swing integrally, or alternatively, there may be employed a system in which a pair of bases disposed upon an endless route are moved by means of an endless chain, in addition to the mill roll stand having the swing arm system described above. In any case, loading and unloading of the web rolls is designed to be achieved by moving a pair of center blocks disposed upon the arms or the bases toward or away from each other with the axes thereof being aligned. When the web roll 14 carried upon the transportation means 17 is to be loaded upon the swing arms 13 of the mill roll stand described above, the center blocks 16 are required to be axially aligned with the axis of the core tube 15 of the web roll 14.

In order to achieve the aforenoted alignment, the axis of each center block 16 travels along the arcuate locus to be traversed by pivoting the swing arm 13 around the axis of the pivotal shaft 12, with the length of the swing arm 13 defining a radius, and consequently, it is not always possible to align the axis of the web rolls 14 having different roll diameters with the axis of the center blocks 16. Accordingly, the operation of centering the center blocks 16 with respect to the core tube 15 has been achieved manually thereby causing automation of this operation to be effectively disregarded.

Moreover, when a web roll 14 has a considerably reduced diameter after consumption of the web as shown in FIG. 7, automatic loading of the web roll is not feasible. More particularly, a brake means 18 is coaxially disposed with respect to the center block 16 attached at the tip of the swing arm 13 for preventing over-run of the web, which may be caused by means of the inertia generated during the rotation of the web roll 14, the same exerting a braking force with respect to the rotation of the center block 16. The brake means 18 may have a considerably large diameter due to its structure, so that its closest approachable distance to the factory ground surface may naturally be limited, thereby preventing it from properly engaging or supporting the core tube of the web roll 14 along the axis of the core tube of the web roll 14 with respect to the transportation means 17, which has a considerably reduced diameter after consumption of the web.

Since automatic chucking by means of the center blocks is feasible under such conditions, difficult manual labor must be exerted by means of the operators in elevating the web roll 14 so as to set the end portions of the core tube 15 upon the center blocks 16. Furthermore, this operation of exchanging web rolls 14 takes considerable time, leading to a disadvantageous reduction in the operational efficiency.

For the purpose of overcoming such problems an invention entitled "Web Feeding Device for Corrugator" has been proposed by the present applicant and filed as Japanese Patent Application No. 221623/1987. The device according to this invention is designed such that a web roll may be elevated by means of a lifter disposed below the swing loci of the swing arms. Accordingly, irrespective of the size of the web roll diameter, the center blocks and the axis of the core tube of the web roll can be aligned so as to allow automatic chucking, and therefore, the time for completion of the roll exchange operation can be minimized. However, in today's corrugated board manufacturing industry where there is a necessity to cope with frequent order changes associated with small lot productions, a further reduction of the cycle time for the web roll exchange operation is desired.

OBJECT OF THE INVENTION

This invention, having been proposed in view of the above problems inherent in the operations of exchanging web rolls and for the purpose of suitably resolving them, is directed toward providing a method of controlling a web feeding device which can further reduce the cycle time of the web roll exchange operations.

SUMMARY OF THE INVENTION

In order to overcome the above problems and to achieve the intended object of the present invention, this invention provides a method of controlling a web feeding device, comprising a pair of center blocks disposed upon predetermined movable members so as to oppose each other with their axes being aligned with respect to each other so as to perform loading and unloading of a web roll by moving closer to or farther away from each other, a lifter disposed adjacent to the movable members and vertically driven after having loaded the web roll thereon, and a sensor which detects the alignment of the pair of center blocks with the core tube of the web roll; wherein:

- the pair of center blocks are stopped at a predetermined position during the ascending stroke of the lifter by moving the movable members;
- the lifter having the web roll loaded thereon is elevated; and
- the alignment of the core tube of the web roll with the pair of center blocks is detected by means of the sensor so as to instantaneously stop the ascending motion of the lifter.

According to the method of controlling the web feeding device the movable members are shifted to predetermined positions and stopped at such positions, and in addition, the lifter carrying the web roll is ascended so as to achieve loading of the web roll securely onto the center blocks provided upon the movable members, whereby reduction of the web roll exchange cycle time can be attained. Even when the outer diameter of the web roll is considerably reduced after feeding or consumption of the web, automatic chucking of the web roll can successfully be achieved since the roll itself is ascended by means of the lifter.

BRIEF DESCRIPTION OF THE DRAWINGS

Various other objects, features, and attendant advantages of the present invention will become more fully appreciated from the following detailed description of the invention, when considered in conjunction with the accompanying drawings, in which like reference characters designate like or corresponding parts throughout the several views, and wherein:

FIG. 3 (*b*), FIG. 4 (*b*) and FIG. 5 (*b*) illustrate corresponding front views of FIG. 3 (*a*), FIG. 4 (*a*) and FIG. 5 (*a*), respectively;

DETAILED DESCRIPTION OF THE INVENTION

Figure 6:
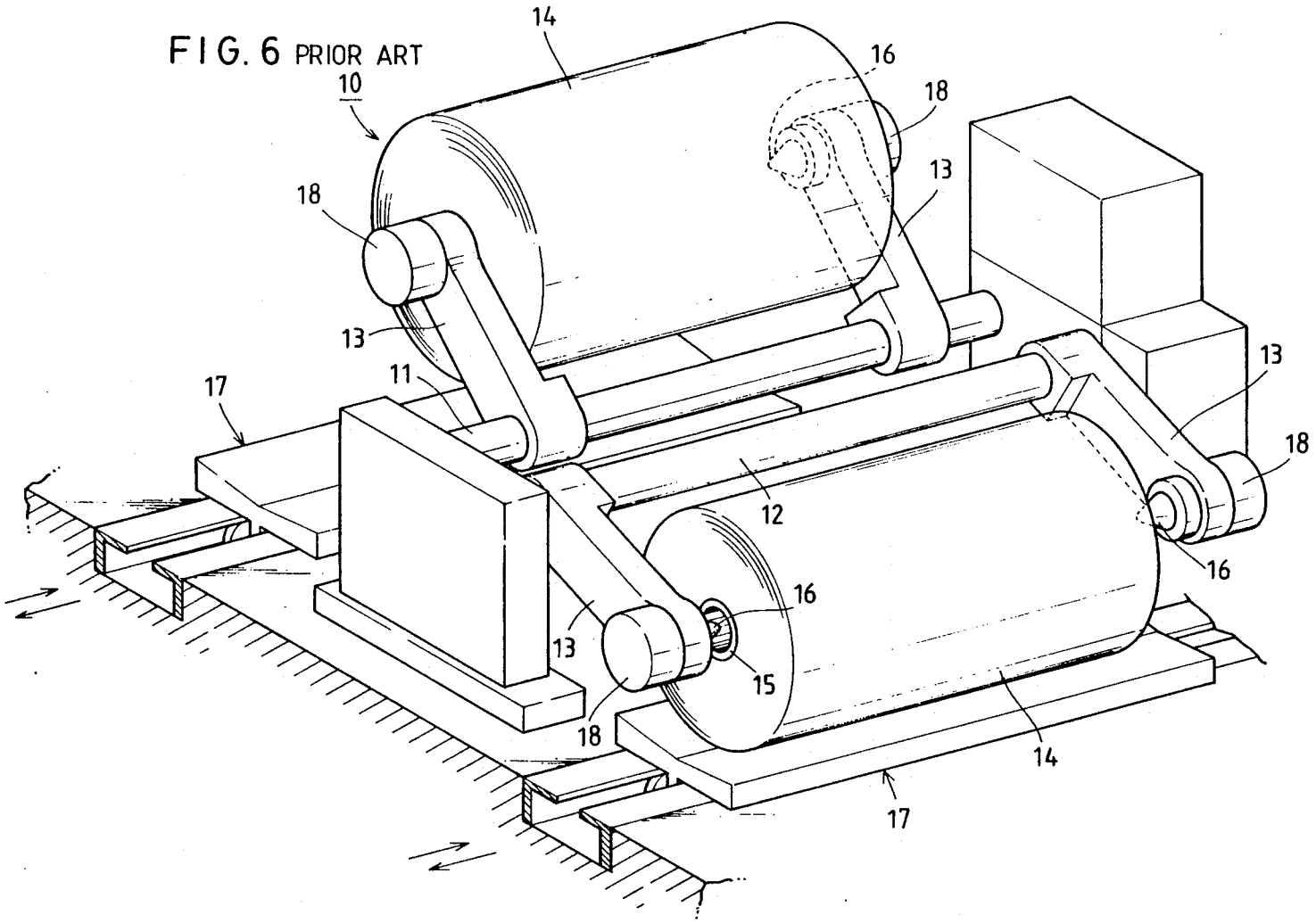
FIG. 6 PRIOR ART
FIG. 6 shows schematically the constitution of a prior art mill roll stand, in perspective view.
Figure 7:
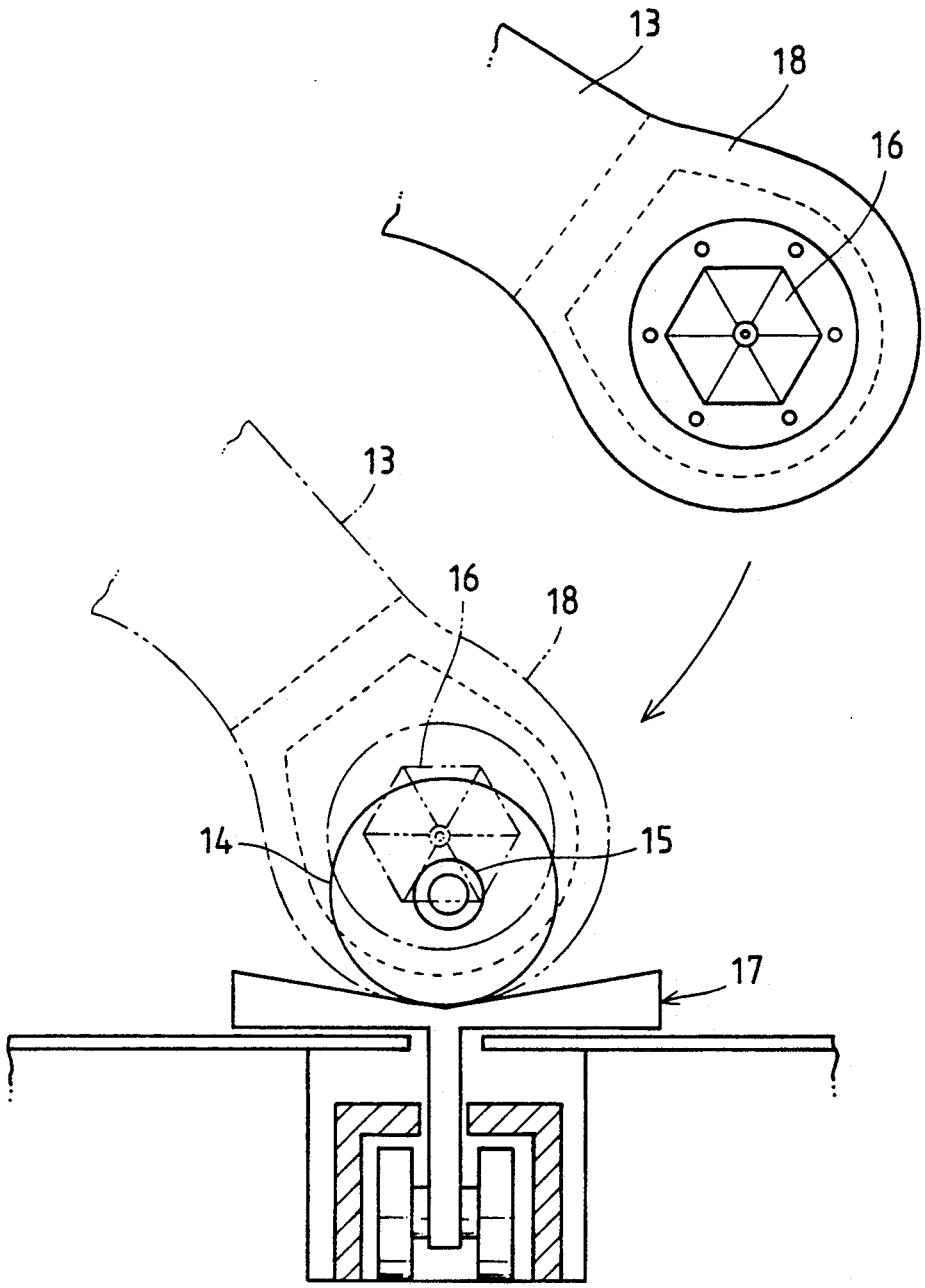
FIG.7 PRIOR ART
FIG. 7 illustrates a state wherein chucking of the web roll having a reduced diameter is not feasible within the mill roll stand shown in FIG. 6.

Next, a preferred embodiment of the method of controlling the web feeding device according to this invention will be described relative to a device in which it can be suitably practiced. Incidentally, the description will be made with respect to the case wherein the present method is employed in connection with a swing arm system mill roll stand. However, application of this invention may not be limited to only such a type of mill roll stand and can be suitably used in connection with the mill roll stand having a turn over system or one which employs an endless route as described above. Referring to FIGS. 6 and 7, the components identical to those described within the paragraph concerning the prior art are indicated with the same reference numerals.

Figure 1:
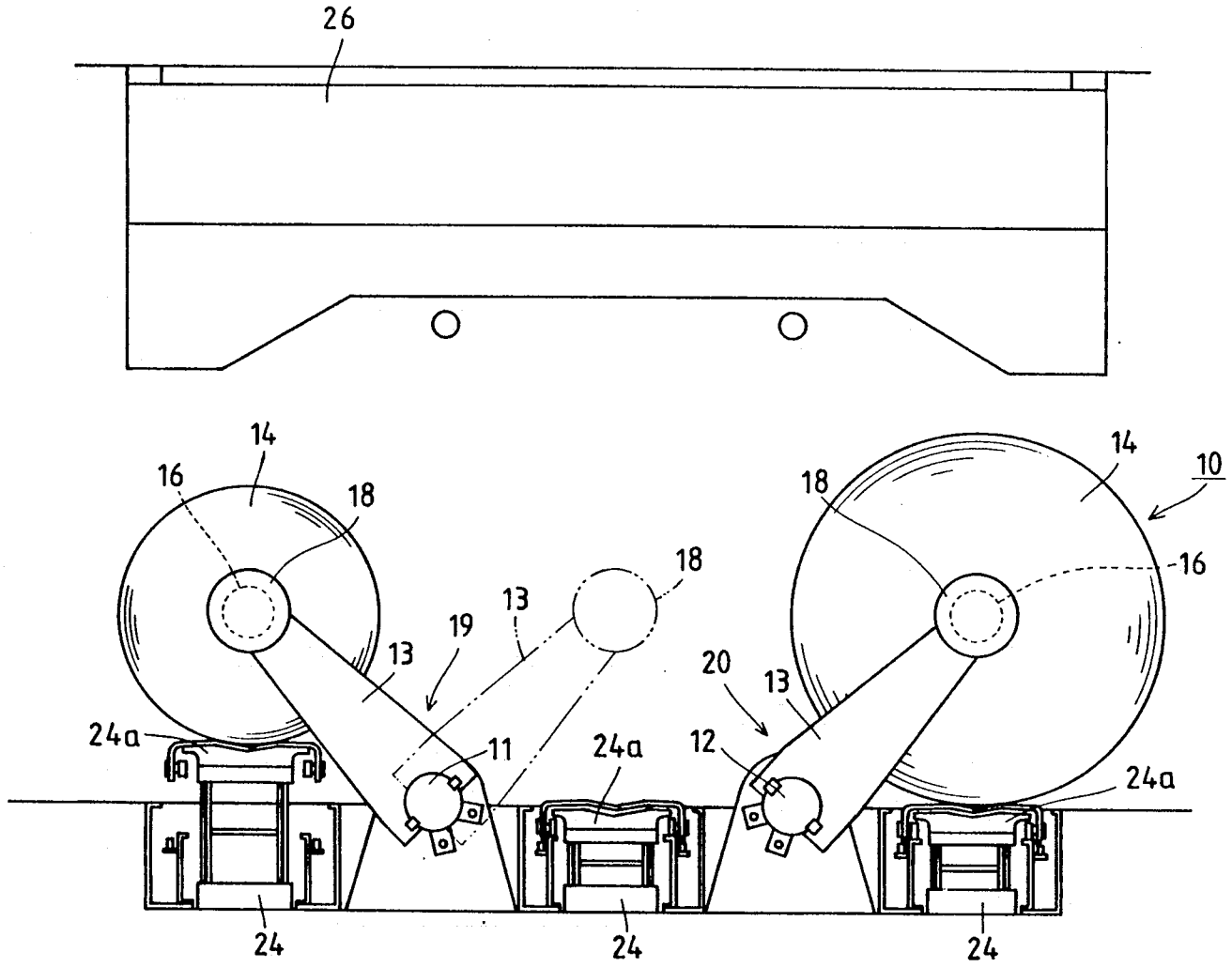
FIG. 1 is a schematic front view of a mill roll stand in which the method of controlling the web feeding device according to this invention can be suitably practiced.

As shown schematically in FIG. 1, a swing arm mechanism constituting a mill roll stand 10 has a pair of swing arms which can be pivoted or rotated through means of a required angle away from the perpendicular line extending upwardly from the hinge portions thereof. In the illustration, two sets of swing arm mechanisms 19 and 20 are shown which are provided for practicing the automatic splicing of webs by means of a splicer 26. However, since these two sets of swing arm mechanisms have exactly the same mechanical constitution, only the swing arm mechanism 19 shown on the left side in FIG. 1 will be described.

Upon the pivotal shaft 11 shown in FIG. 1, a pair of swing arms 13 (see FIG. 2) are connected at hinge portions thereof by means of splines, and are designed to be movable toward or away from each other upon actuation of hydraulic cylinders (not shown) in the positive or negative direction. The pivotal shaft 11 is turned within a predetermined angular range together with the pair of swing arms 13 by means of a hydraulic cylinder (not shown).

Figure 2:
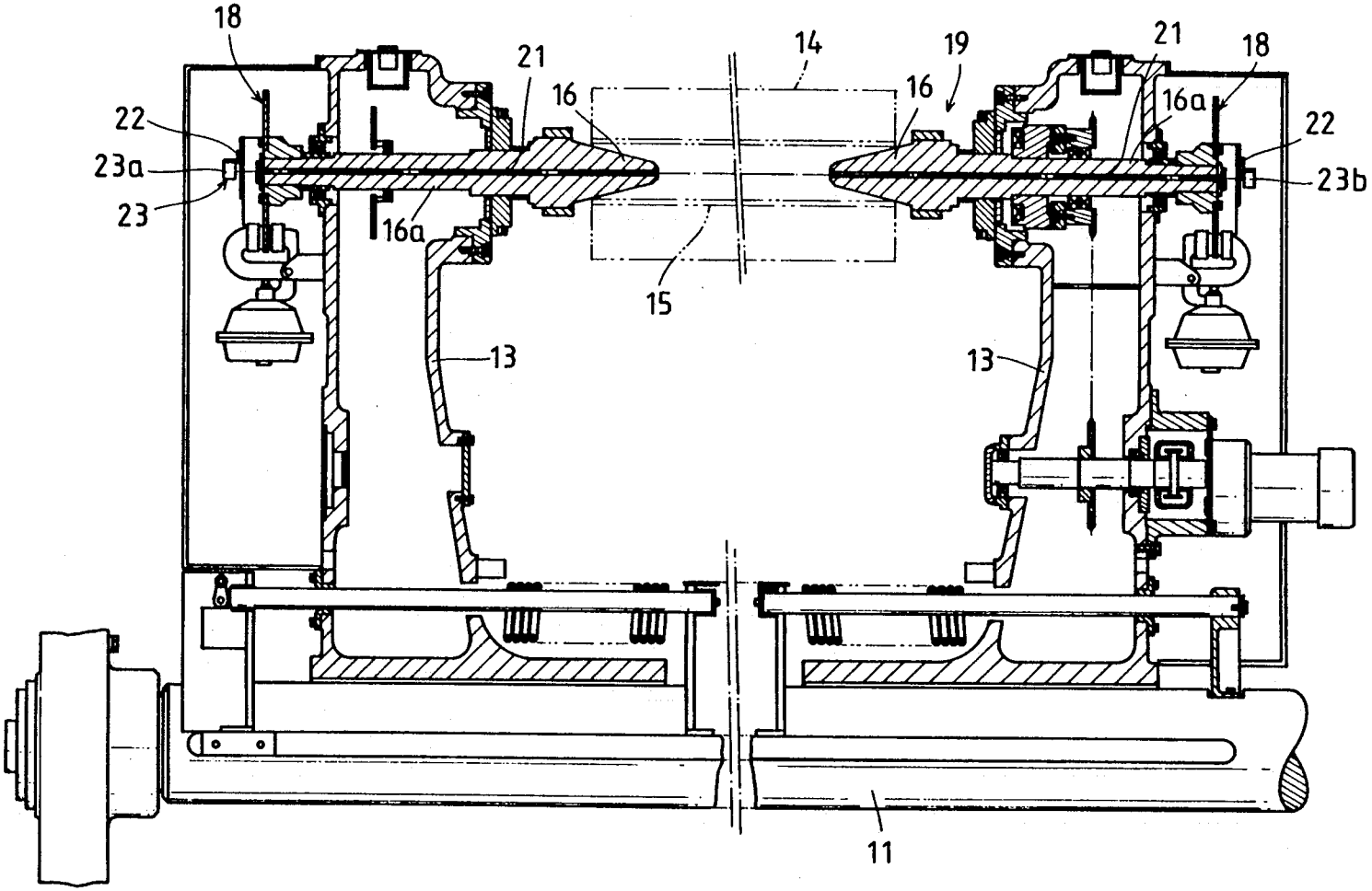
FIG. 2 shows, in vertical cross-section, a swing arm mechanism of the mill roll stand shown in FIG. 1.

At the end portion of each swing arm 13, a center block 16 projects axially inwardly so as to oppose the other center block 16 projecting from the end portion of the other swing arm 13 so as to form a pair of swing arms with the former swing arm as shown in FIG. 2, so as to allow chucking of a core tube 15 of the web roll 14 at both ends thereof by means these two center blocks 16. These center blocks 16 are designed to be turned integrally with the web roll 14 chucked by means of these two center blocks 16 and supported by means of the arms 13 such that the blocks may be rotatable through means of the rotary shaft 16*a*. The pivotal shaft 11 is controlled so as to stop at an angle such that the axes of the center blocks 16 upon the swing arms 13 may be disposed upon the vertical perpendicular center line of a lifter 24 to be described later (see FIG. 3 (*b*)).

A through hole 21 is formed along the axis of each center block 16 and rotary shaft 16*a* contiguous thereto, whereby the axis of the core tube of the web roll 14 can be detected by means of a sensor 23 disposed upon the rear side of each swing arm 13 by means of a bracket 22. More particularly, the sensor 23 comprises a light emitting means 23*a* disposed upon one arm 13, and a light receiving means 23*b* disposed upon the other arm 13, such as, for example, a photoelectric switch, wherein the switch is turned ON when light emitted from the light emitting means 23*a* impinges upon the light receiving means 23*b* through means of the through holes 21 of the two center blocks 16. Incidentally, this sensor 23 has a circuit which is designed to deliver a command to stop the elevation of the lifter 24 (to be described later) by experiencing an ON state, an OFF state and again an ON state.

At the position adjacent to the mill roll stand 10 and below the swing loci of the swing arms 13, a pantographic lifter 24 is disposed. This lifter 24 is adapted to ascend or descend so as to vertically move the web roll 14 carried upon the table 24*a* thereof within a predetermined perpendicular range of movement, and it is noted that the basic structure thereof is known. Therefore, by elevating the web roll 14 carried upon the lifter 24 when the swing arms 13 are located above the lifter 24, axial alignment of the core tube 15 of the web roll 14 and the two opposing center blocks 16 upon the swing arms 13 can be achieved.

Subsequently, the web roll 14 carried upon the lifter 24 can be chucked by means of these two center blocks 16 by moving the swing arms 13 closer to each other.

Figure 3:
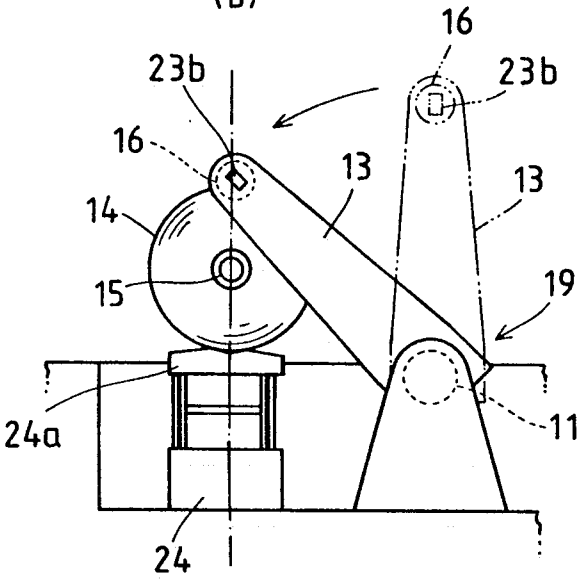
FIG. 3 (*a*), FIG. 4 (*a*) and FIG. 5 (*a*) illustrate, each in side view, the operational order with the passage of time of the mill roll stand when the same is operated in accordance with the controlling method according to this invention so as to achieve alignment and mounting of the web feed roll with, and upon, the center blocks.
Figure 3:
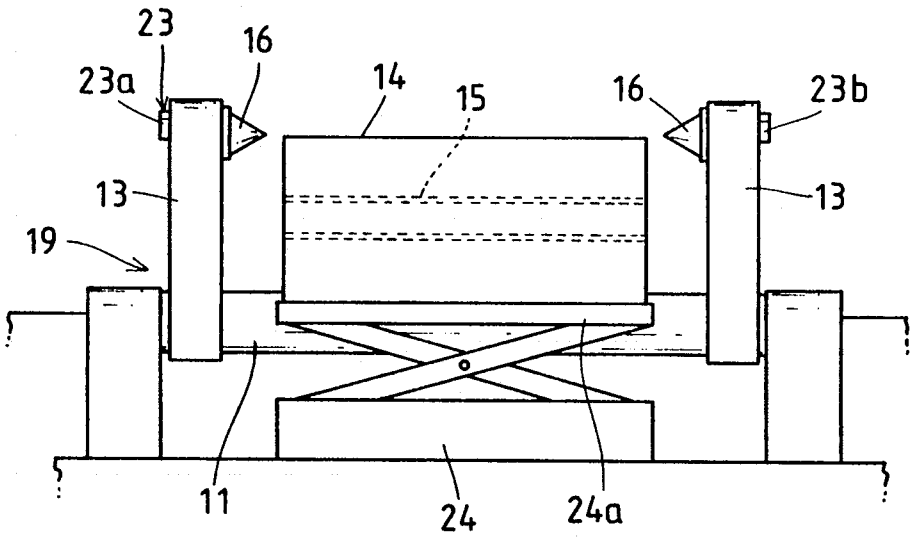
Figure 4:
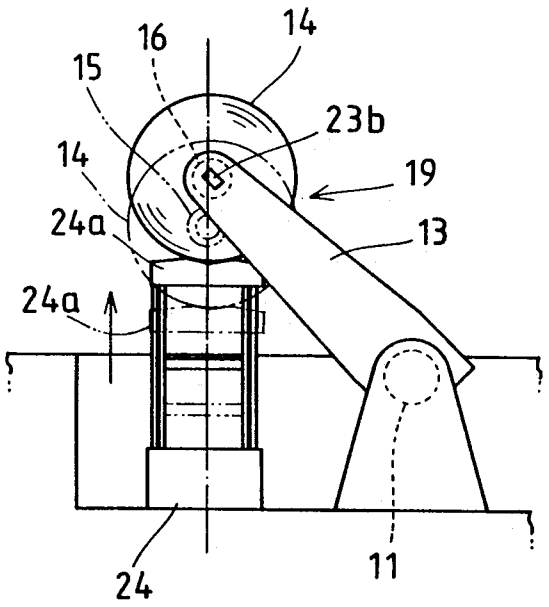
Figure 4:
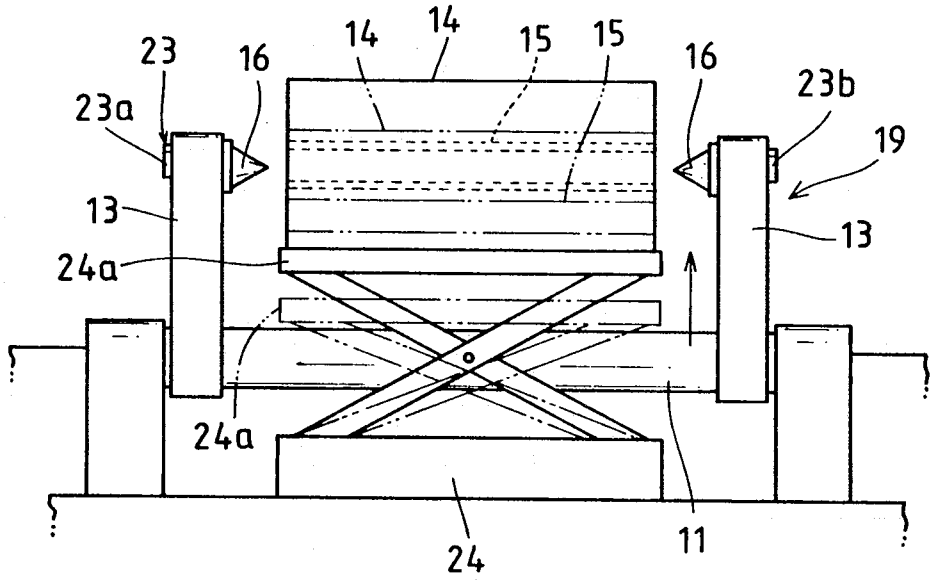
Figure 5:
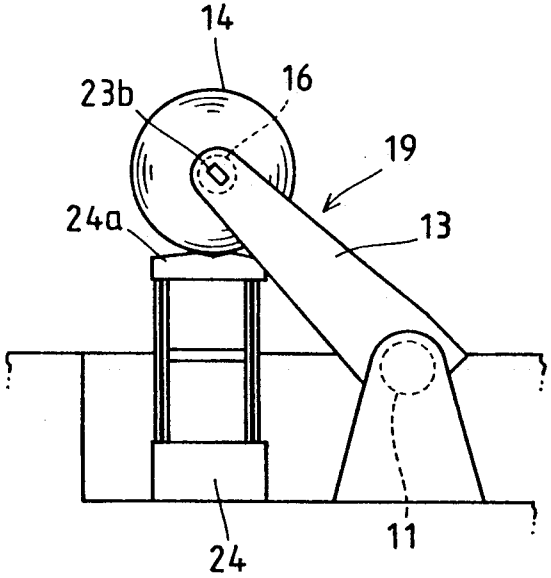
Figure 5:
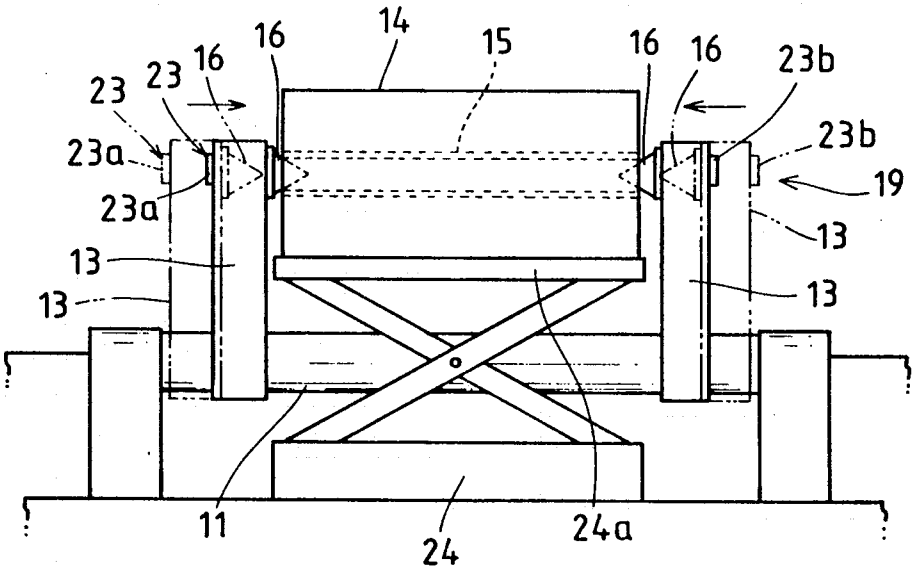

Next, a description will be made with respect to the mill roll stand based upon the basic construction thereof when it is controlled according to the present method with reference being made to the operational illustrations shown in FIGS. 3 to 5. First, a new or fresh web roll 14 is transported from the stockyard (not shown) and loaded onto the table 24*a* of the lifter 24 disposed adjacent to the mill roll stand 10. In this state, the swing arms 13 start to turn in the counterclockwise direction under the action of the hydraulic cylinder (not shown) as shown in FIG. 3 (*b*). The maximum rotational angle of the swing arms 13 is determined by means of the stroke length of the piston of the hydraulic cylinder. The arms 13 are pivoted until they reach a position at which the axes of the two center blocks 16 are disposed upon the perpendicular center line of the lifter 24 and are stopped at such position with a leftwardly tilted posture so as to assume a stand-by posture. The pair of arms 13 are spaced from each other in the axial direction so as to allow the center blocks 16 to be open or unchucked, as shown in FIG. 3 (*a*).

Upon detection of a signal indicating stopping of the swing arms 13 at the predetermined position (for example, a detection signal of such a limit switch as described above), the lifter 24 is driven by a predetermined driving by means of source (not shown), such as, for example, a hydraulic cylinder, so as to start ascending. When the lifter 24 ascends to a predetermined level, the optical axes of the light emitting means 23*a* and the light receiving means 23*b* are first intercepted by means of the web wound portion of the web roll 14, and the switch assumes an OFF state. As the lifter 24 further ascends until the axis of the core tube 15 of the web roll 24 reaches the position where it is aligned with the axes of the center blocks 16, the optical axes of the light emitting and light receiving means 23*a* and 23*b* are resumed, whereby the switch assumes an ON state. At this moment, a stop command is delivered from the sensor 23 so as to instantaneously stop elevation of the lifter 24. Thereafter, the hydraulic cylinders are synchronously actuated so as to move the arms 13 closer to each other as shown in FIG. 5 (*b*), whereby chucking of the web roll 14 by means of the center blocks 16 can securely be effected.

Obviously, many modifications and variations of the present invention are possible in light of the above teachings. It is therefore to be understood that within the scope of the appended claims, the present invention may be practiced otherwise than as specifically described herein.

What is claimed is:

1. A method of mounting a web roll, having a web of material coiled about an axis thereof, upon a pair of axially opposed center blocks, which are in turn respectively mounted upon end portions of a pair of arms which are pivotably mounted upon support means about a pivotal axis thereof and which are also translatably movable along said pivotal axis so as to move said center blocks toward and away from each other in order to facilitate loading and mounting of said web roll upon said center blocks of said arms, comprising the steps of:

disposing said pair of arms at axial positions with respect to each other such that said center blocks are axially spaced from each other so as to permit said web roll to be interposed between said center blocks during said loading and mounting of said web roll upon said center blocks;

disposing a lifting device, which is vertically movable within a vertical plane, at a lowered position;

depositing a web roll upon said lifting device disposed at said lowered position;

pivotably moving said pair of arms, with said center blocks disposed thereon, until said center blocks intersect and are aligned with said vertical plane within which said lifting device is movable whereupon said pivotable movement of said pair of arms and said center blocks is terminated so as to dispose said center blocks at a waiting position;

moving said lifting device vertically upwardly within said vertical plane from said lowered position until said axis of said web roll is aligned with the respective axes of said axially opposed center blocks disposed at said waiting position at which time said vertical movement of said lifting device is terminated; and moving said pair of arms axially toward each other from said axial positions such that said axially spaced, axially opposed center blocks can engage opposite end portions of said web roll whereby said web roll is mounted upon said center blocks.

2. A method as set forth in claim 1, further comprising the step of:

sensing the coaxial alignment of said center blocks with said axis of said web roll whereupon said vertical movement of said lifting device within said vertical plane is instantaneously terminated.

3. A method as set forth in claim 1, further comprising the step of:

optically sensing the coaxial alignment of said center blocks with said axis of said web roll whereupon said vertical movement of said lifting device within said vertical plane is instantaneously terminated.

4. A method as set forth in claim 3, wherein:

said optical sensing of said coaxial alignment of said center blocks and said web roll is achieved by utilizing photoelectric means disposed within said pair of arms upon which said axially spaced center blocks are mounted.

5. A method as set forth in claim 1, further comprising the step of:

disposing sensing means upon each of said pair of arms at positions radially offset with respect to said axes of said center blocks such that upon achievement of sensing communication of said sensing means with respect to each other as a result of said vertical movement of said lifting device from said lowered position, said axis of said web roll will be coaxially aligned with said respective axes of said center blocks so as to instantaneously terminate said vertical movement of said lifting device.

6. A method as set forth in claim 1, further comprising the step of:

disposing optical sensing means upon each of said pair of arms at positions radially offset with respect to said axes of said center blocks such that upon achievement of optical sensing communication between said sensing means with respect to each other as a result of said vertical movement of said lifting device from said lowered position, said axis of said web roll will be coaxially aligned with said respective axes of said center blocks so as to instantaneously terminate said vertical movement of said lifting device.

7. A method as set forth in claim 6, wherein:

said optical sensing means comprises a light emitting means disposed upon one of said pair of arms, and a light receiving means disposed upon the other one of said pair of arms.

8. A method of mounting a web roll, having a web of material coiled about an axis thereof, upon a pair of axially opposed center blocks, which are in turn respectively mounted upon end portions of a pair of arms which are pivotably mounted upon support means about a pivotal axis thereof and which are also translatably movable along said pivotal axis so as to move said center blocks toward and away from each other in order to facilitate loading and mounting of said web roll upon said center blocks of said arms, comprising the steps of:

disposing said pair of arms at axial positions with respect to each other such that said center blocks are axially spaced from each other so as to permit said web roll to be interposed between said center blocks during said loading and mounting of said web roll upon said center blocks;

disposing a lifting device, which is vertically movable within a vertical plane, at a lowered position;

pivotably moving said pair of arms, with said center blocks disposed thereon, until said center blocks intersect and are aligned with said vertical plane within which said lifting device is movable whereupon said pivotable movement of said pair of arms and said center blocks is terminated so as to dispose said center blocks at a waiting position;

depositing a web roll upon said lifting device disposed at said lowered position;

moving said lifting device vertically upwardly within said vertical plane from said lowered position until said axis of said web roll is coaxially aligned with the respective axes of said axially opposed center blocks disposed at said waiting position at which time said vertical movement of said lifting device is terminated; and moving said pair of arms axially toward each other from said axial positions such that said axially spaced, axially opposed center blocks can engage opposite end portions of said web roll whereby said web roll is mounted upon said center blocks.

9. A method as set forth in claim 8, further comprising the step of:

sensing the coaxial alignment of said center blocks with said axis of said web roll whereupon said vertical movement of said lifting device within said vertical plane is instantaneously terminated.

10. A method as set forth in claim 8, further comprising the step of:

optically sensing the coaxial alignment of said center blocks with said axis of said web roll whereupon said vertical movement of said lifting device within said vertical plane is instantaneously terminated.

11. A method as set forth in claim 10, wherein:

said optical sensing of said coaxial alignment of said center blocks and said web roll is achieved by utilizing a light emitting means disposed upon one of said pair of arms, and a light receiving means disposed upon the other one of said pair of arms.

12. A method as set forth in claim 8, further comprising the step of:

disposing sensing means upon each of said pair of arms at positions radially offset with respect to said axes of said center blocks such that upon achievement of sensing communication of said sensing means with respect to each other as a result of said vertical movement of said lifting device from said lowered position, said axis of said web roll will be coaxially aligned with said respective axes of said center blocks so as to instantaneously terminate said vertical movement of said lifting device.

13. A method as set forth in claim 8, further comprising the step of:

disposing optical sensing means upon each of said pair of arms at positions radially offset with respect to said axes of said center blocks such that upon achievement of optical sensing communication between said sensing means with respect to each other as a result of said vertical movement of said lifting device from said lowered position, said axis of said web roll will be coaxially aligned with said respective axes of said center blocks so as to instantaneously terminate said vertical movement of said lifting device.

14. A method as set forth in claim 13, wherein:

said optical sensing means comprises a light emitting means disposed upon one of said pair of arms, and a light receiving means disposed upon the other one of said pair of arms.

15. Apparatus for mounting a web roll, having a web of material coiled about an axis thereof, upon a pair of axially opposed center blocks, comprising:

support means;

a pair of arms, having said center blocks mounted upon end portions thereof, pivotably mounted upon said support means about a pivotal axis thereof and translatably movable along said pivotal axis so as to move said center blocks toward and away from each other between a first position at which said center blocks are axially spaced from each other so as to permit said web roll to be interposed between said center blocks during said loading and mounting of said web roll upon said center blocks of said arms, and a second position at which said center blocks are axially spaced from each other so as to permit said center blocks to engage opposite end portions of said web roll whereby said web roll will be mounted upon said center blocks;

a lifting device vertically movable within a vertical plane from a lowered position at which a web roll is deposited thereon to an elevated position at which said web roll can be mounted upon said center blocks;

means for pivotably moving said pair of arms, and said center blocks disposed thereon, from a first position displaced from said vertical plane of movement of said lifting device to a second position at which said center blocks intersect and are aligned with said vertical plane within which said lifting device is movable so as to await the arrival of said web roll elevated by said lifting device; and means for moving said lifting device, vertically upwardly within said vertical plane from said lowered position toward said elevated position, until said axis of said web roll is aligned with the respective axes of said axially opposed center blocks disposed at said waiting position at which time said vertical movement of said lifting device is terminated.

16. Apparatus as set forth in claim 15, further comprising:

means for sensing the coaxial alignment of said center blocks with said axis of said web roll whereupon said vertical movement of said lifting device within said vertical plane is instantaneously terminated.

17. Apparatus as set forth in claim 15, further comprising:

means for optically sensing the coaxial alignment of said center blocks with said axis of said web roll whereupon said vertical movement of said lifting device within said vertical plane is instantaneously terminated.

18. Apparatus as set forth in claim 16, wherein:

said optically sensing means comprises light emitting means disposed upon one of said pair of arms, and a light receiving means disposed upon the other one of said pair of arms.

19. Apparatus as set forth in claim 16, wherein:

said sensing means are disposed upon each of said pair of arms at positions radially offset with respect to said axes of said center blocks such that upon achievement of sensing communication of said sensing means with respect to each other as a result of said vertical movement of said lifting device from said lowered position toward said elevated position, said axis of said web roll will be coaxially aligned with said respective axes of said center blocks so as to instantaneously terminate said vertical movement of said lifting device.

20. Apparatus as set forth in claim 17, wherein:

said optical sensing means are disposed upon each of said pair of arms at positions radially offset with respect to said axes of said center blocks such that upon achievement of optical sensing communication between said sensing means with respect to each other as a result of said vertical movement of said lifting device from said lowered position toward said elevated position, said axis of said web roll will be coaxially aligned with said respective axes of said center blocks so as to instantaneously terminate said vertical movement of said lifting device.

21. Apparatus as set forth in claim 20, wherein:

said optical sensing means comprises light emitting means disposed upon one of said pair of arms, and a light receiving means disposed upon the other one of said pair of arms.

* * * * *